US010733827B2

(12) United States Patent
Wu et al.

(10) Patent No.: US 10,733,827 B2
(45) Date of Patent: Aug. 4, 2020

(54) CARD STORING CASE

(71) Applicant: Shenzhen Tianyi Technology Co., Ltd., Shenzhen (CN)

(72) Inventors: Bin Wu, Shenzhen (CN); Xiaodong Qian, Shenzhen (CN); Kai Liu, Shenzhen (CN); Su Rong, Shenzhen (CN)

(73) Assignee: SHENZHEN TIANYI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/293,012

(22) Filed: Mar. 5, 2019

(65) Prior Publication Data

US 2019/0279455 A1 Sep. 12, 2019

(30) Foreign Application Priority Data

Mar. 6, 2018 (CN) ..... 2018 2 0310198 U

(51) Int. Cl.
*G07F 7/08* (2006.01)

(52) U.S. Cl.
CPC ..... *G07F 7/08* (2013.01)

(58) Field of Classification Search
CPC ..... A45C 11/18; B65D 83/0829; B65D 83/12
USPC ..... 221/232, 242, 255, 268, 270
See application file for complete search history.

(56) References Cited

U.S. PATENT DOCUMENTS 3,308,989 A * 3/1967 Alltop ..... A45C 11/18 221/232
4,023,705 A * 5/1977 Reiner ..... A63F 1/14 221/186
4,045,102 A * 8/1977 Austin ..... B42F 7/14 312/61
4,792,058 A * 12/1988 Parker ..... B65D 83/12 206/39.4
4,887,739 A * 12/1989 Parker ..... A45C 11/18 221/232
5,240,140 A * 8/1993 Huen ..... A63F 1/12 221/13
5,615,800 A * 4/1997 Meyers ..... B65H 3/02 221/232
5,730,319 A * 3/1998 Gray ..... A45C 11/18 221/232
5,894,954 A * 4/1999 Horian ..... B65H 1/04 206/39.4

(Continued)

*Primary Examiner* — Gene O Crawford
*Assistant Examiner* — Ayodeji T Ojofeitimi
(74) *Attorney, Agent, or Firm* — Nath, Goldberg & Meyer; Joshua B. Goldberg

(57) ABSTRACT

A card storing case includes a left plate and a right plate arranged opposite to one another. An inner side of the left plate and an inner side of the right plate are respectively provided with a plurality of guide grooves. The card storing case further includes a card bracket slidably arranged in the guide groove. When a card is transferred into the card bracket, the card bracket slides along the guide groove, such that the card is moved and stored in the guide groove. A card bracket and a guide groove are arranged in the card storing case, such that a card is moved and stored in the guide groove via the card bracket, which not only shortens a transfer path of the card in a process of storing or withdrawing the card, but also reduces operation time in storing or withdrawing the card.

8 Claims, 4 Drawing Sheets

(56) References Cited

U.S. PATENT DOCUMENTS 6,010,031 A * 1/2000 Fox ..... B65D 83/0858 221/283
6,050,449 A * 4/2000 Kanj ..... B65D 83/12 206/39.4
6,082,581 A * 7/2000 Anderson ..... B65D 83/087 221/232
6,155,456 A * 12/2000 Archer ..... B65H 1/00 221/231
6,662,968 B2 * 12/2003 Clements ..... G07F 11/04 221/242
6,938,896 B2 * 9/2005 Tsuchida ..... A63F 1/14 221/268
7,004,312 B2 * 2/2006 Chen ..... A45C 11/18 206/232
7,614,478 B2 * 11/2009 Hmayakyan ..... A61B 7/02 181/131
7,946,450 B2 * 5/2011 Gelardi ..... B65D 50/046 221/154
8,443,854 B2 * 5/2013 Long ..... A45C 11/182 150/131
8,567,641 B2 * 10/2013 Kobayashi ..... B65H 1/00 206/39
2002/0074246 A1 * 6/2002 Tiscione ..... A45C 11/182 206/39.4
2005/0274733 A1 * 12/2005 Fusi ..... G07F 11/44 221/232
2006/0027593 A1 * 2/2006 Slocum ..... B60R 11/00 221/232
2006/0113315 A1 * 6/2006 Chen ..... G02B 21/34 221/268
2006/0191952 A1 * 8/2006 Kalra ..... B65H 1/06 221/268
2008/0142540 A1 * 6/2008 Chang ..... B65D 83/0864 221/259
2008/0245814 A1 * 10/2008 Rogow ..... B65D 83/0817 221/268
2011/0108565 A1 * 5/2011 Patton et al. ..... A45C 11/18 221/37
2011/0233229 A1 * 9/2011 Schekalla ..... B65D 83/0829 221/270
2014/0014676 A1 * 1/2014 Minson ..... B65D 83/0829 221/226

* cited by examiner

CARD STORING CASE

FIELD OF TECHNOLOGY

The present application relates to the field of mechanical technologies, and more particularly, to a card storing case.

BACKGROUND

Various types of cards such as bank cards and transportation cards are an indispensable part of people's daily lives. Taking chip cards as an example, the chip cards not only support a variety of financial applications such as loan and credit, electronic cash, electronic wallet, offline payment, fast payment and so on, but also may be applied to many industry sectors such as transportations, communications, businesses, education, medical treatment, social security, tourism and entertainment, and so on. The chip cards can really achieve multipotent effects and provide customers with more abundant value-added services.

To facilitate people to handle businesses, banks are equipped with self-service card issuing machines to help customers to obtain the chip cards to handle self-service businesses. Meanwhile, in some cases, the customers also may likely need to store the cards into the card issuing machines. For example, upon the expiration of the validity period of the cards, the customers need to store the original old cards into the card issuing machines and reapply for new cards.

However, in the structure of an existing card issuing machine, paths of issuing and storing cards are too long, and when in use, the customers need to wait for a long time to complete a normal card issuing or card storing operation.

SUMMARY

In view of the aforementioned problems, the present application is proposed to provide a card storing case to overcome the aforementioned problems or at least partially solve the aforementioned problems.

To solve the aforementioned problems, the present application discloses a card storing case, which includes:

a left plate of the card storing case and a right plate of the card storing case arranged opposite to one another, wherein an inner side of the left plate of the card storing case and an inner side of the right plate of the card storing case are respectively provided with a plurality of guide grooves; and a card bracket slidably arranged in the guide groove.

When a card is transferred into the card bracket, the card bracket slides along the guide groove, such that the card is moved and stored in the guide groove.

Alternatively, the card storing case further includes an upper connection plate of the card storing case, a lower connection plate of the card storing case, and a support plate of the card storing case. The card storing case is enclosed and formed by the left plate of the card storing case, the right plate of the card storing case, the upper connection plate of the card storing case, the lower connection plate of the card storing case, and the support plate of the card storing case.

Alternatively, the upper connection plate of the card storing case, the lower connection plate of the card storing case and the support plate of the card storing case together form a frame of the card storing case, and both the left plate of the card storing case and the right plate of the card storing case are fixed to the support plate of the card storing case, such that the card storing case is formed.

Alternatively, the card bracket includes a card blocking portion arranged at an end of the card bracket, and the card is transferred into the card bracket and gets in touch with the card blocking portion.

Alternatively, the card blocking portion further includes at least one fixed contact piece, and when an end of the card gets in touch with the card blocking portion, the card is fixed to the card bracket by the fixed contact piece.

Alternatively, the card bracket further includes a locking portion, and when the locking portion is locked with a card support clip of a pulley, driven by the card support clip, the card bracket slides along the guide groove.

Alternatively, the card storing case is connected to a pulley, and the card and the card bracket are driven to slide by a pulley combination wheel and a card support clip of the pulley.

Alternatively, when the card is stored, the card bracket is withdrawn, by the card support clip of the pulley, from the guide groove of the card storing case to a specified position. After the card is transferred, by the pulley, into the card bracket, the card support clip of the pulley pushes, along the guide groove, the card bracket and the card into the card storing case.

Alternatively, the number of the guide grooves in the inner side of the left plate of the card storing case is equal to that of the guide grooves in the inner side of the right plate of the card storing case.

Compared with the background art, the present application includes the following advantages.

According to an embodiment of the present application, a card bracket and a guide groove are arranged in the card storing case, such that a card is moved and stored in the guide groove via the card bracket, which not only shortens a transfer path of the card in a process of storing or withdrawing the card, but also reduces operation time in storing or withdrawing the card. The card storing case of this embodiment is provided with a plurality of guide grooves, which not only increases the number of cards stored in the card storing case, but also enhances the capacity of the card storing case.

DESCRIPTION OF THE EMBODIMENTS

To make the foregoing objectives, features, and advantages of the present application more apparent and lucid, the present application is further described in detail below with reference to the accompanying drawings and embodiments.

Figure 1:
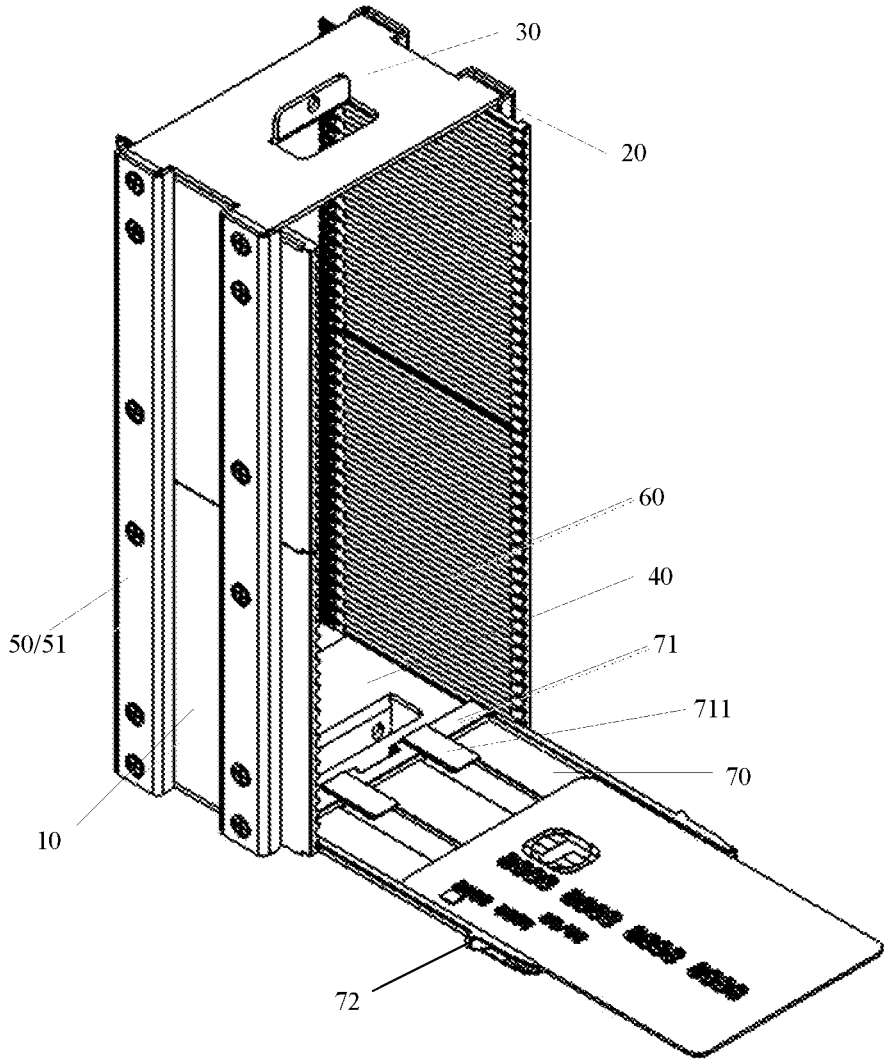
FIG. 1 is a structural block diagram of a card storing case according to an embodiment of the present application.
Figure 2:
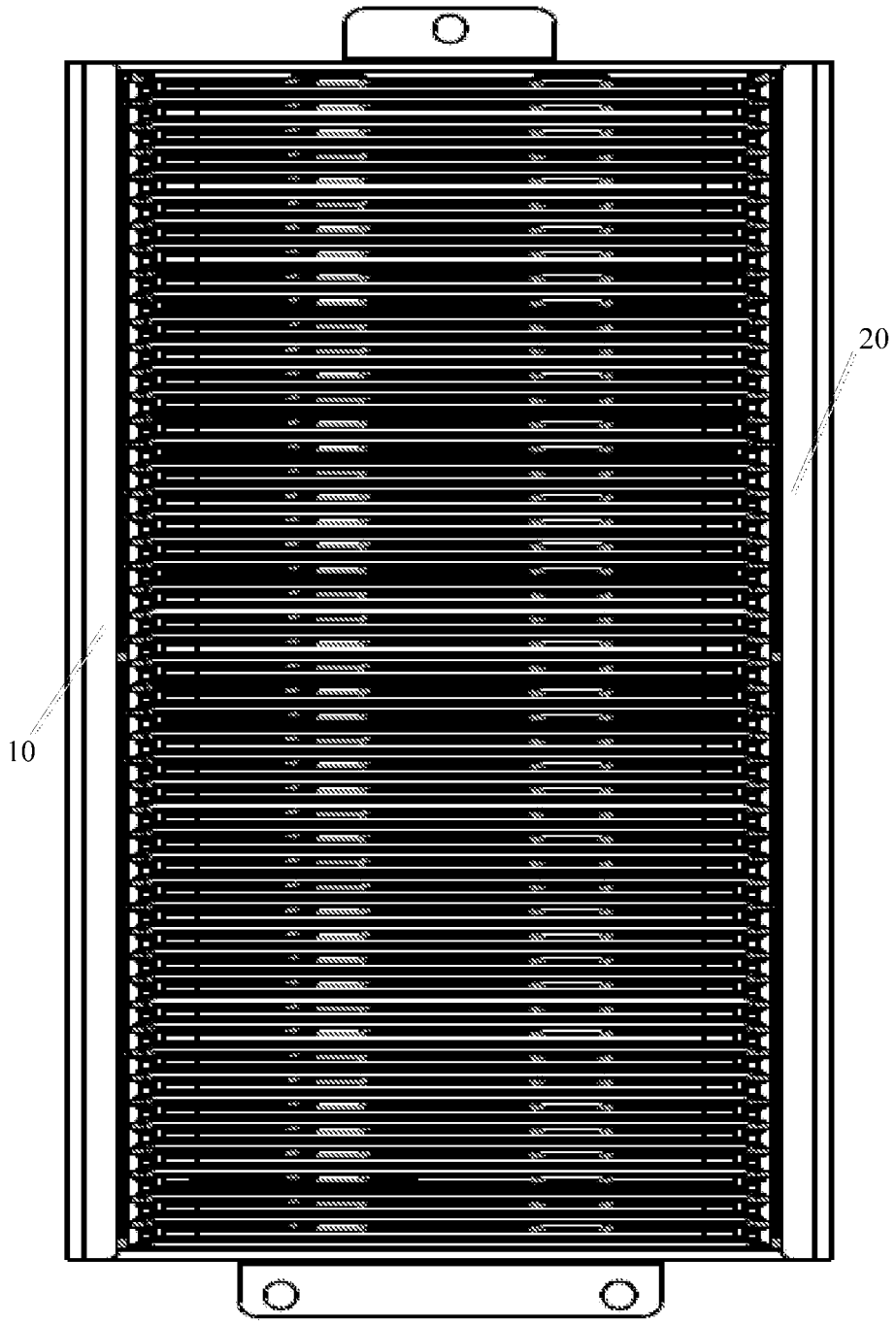
FIG. 2 is a front view of a card storing case according to an embodiment of the present application.
Figure 3:
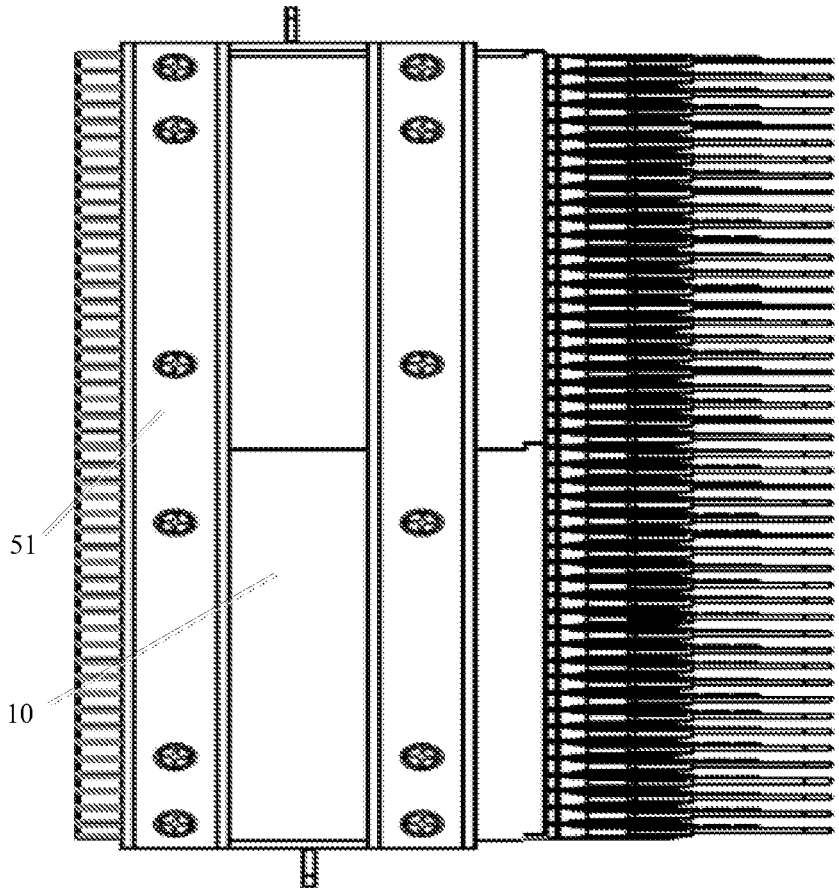
FIG. 3 is a left view of a card storing case according to an embodiment of the present application.
Figure 4:
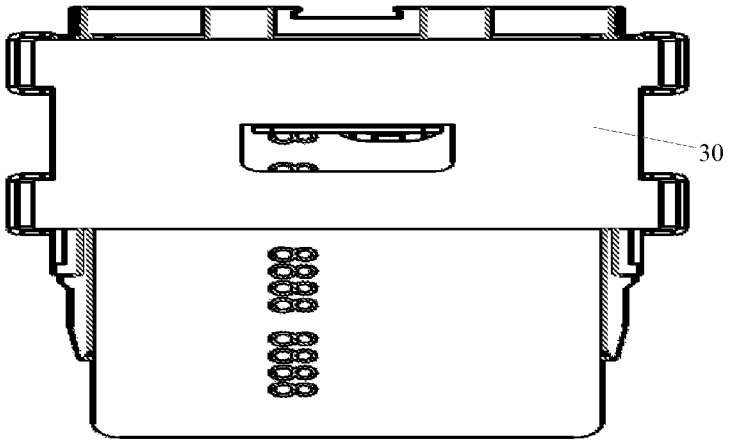
FIG. 4 is a top view of a card storing case according to an embodiment of the present application.
Figure 5:
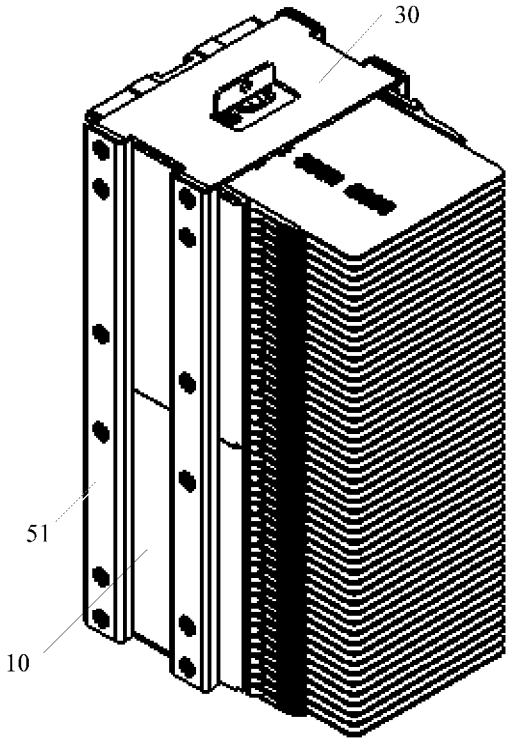
FIG. 5 is a stereoscopic view of a card storing case according to an embodiment of the present application.

Referring to FIG. 1, a structural block diagram of a card storing case according to an embodiment of the present application is illustrated, and the card storing case specifically may include:

a left plate 10 of the card storing case and a right plate 20 of the card storing case which may be arranged opposite to one another.

It is to be noted that the card storing case in this embodiment may be used for storing various kinds of cards. For example, the various kinds of cards may include bank cards, parking cards, transportation cards, and so on. In this embodiment, it is not limited what kind of cards the card storing case is specifically used in.

Of course, the card storing case in the embodiment of the present application may further include an upper connection plate 30 of the card storing case, a lower connection plate 40 of the card storing case, and a support plate 50 of the card storing case. The card storing case is enclosed and formed by the left plate 10 of the card storing case, the right plate 20 of the card storing case, the upper connection plate 30 of the card storing case, the lower connection plate 40 of the card storing case, and the support plate 50 of the card storing case.

To ensure the stability of the card storing case, according to the embodiment of the present application, the upper connection plate 30 of the card storing case, the lower connection plate 40 of the card storing case and the support plate 50 of the card storing case together form a frame of the card storing case, and then both the left plate 10 of the card storing case and the right plate 20 of the card storing case may be fixed to the support plate 50 of the card storing case, such that the card storing case is formed. In specific implementation, the support plate 50 of the card storing case may be further divided into a left support plate 51 of the card storing case (i.e., the support plate 50 of the card storing case as shown in FIG. 1) and a right support plate 52 of the card storing case (not shown in the figure). The left plate 10 of the card storing case may be fixed to the left support plate 51 of the card storing case, and the right plate 20 of the card storing case may be fixed to the right support plate 52 of the card storing case.

The left plate 10 of the card storing case, the right plate 20 of the card storing case, the upper connection plate 30 of the card storing case, the lower connection plate 40 of the card storing case and the support plate 50 of the card storing case may be made from specific materials selected according to the actual needs, which is not limited in the this embodiment.

In the embodiment of the present application, an inner side of the left plate 10 of the card storing case and an inner side of the right plate 20 of the card storing case also may be respectively provided with a plurality of guide grooves 60, and each of the guide grooves 60 may be used for storing a card when the card is stored or withdrawn. Therefore, the number of the guide grooves 60 in the inner side of the left plate 10 of the card storing case is equal to that of the guide grooves 60 in the inner side of the right plate 20 of the card storing case.

In the embodiment of the present application, the card storing case further includes a card bracket 70 slidably arranged in the guide groove 60. When a card is stored, the card may be first stored in the card bracket 70, and then may be stored in the guide groove 60 by the movement of the card bracket 70.

In specific implementation, when the card is transferred into the card bracket 70 by a front end module, the card bracket 70 may slide along the guide groove 60 and move and store the card in the guide groove 60. In this way, an operation of storing the card is completed.

In the embodiment of the present application, the card bracket 70 may further include a card blocking portion 71 which may be arranged at an end of the card bracket 70 close to the inner side of the card storing case. When the card is transferred into the card bracket 70, the card bracket 70 may get in touch with the card through the card blocking portion 71, such that the card is prevented from sliding out of the card bracket 70 or the card storing case.

In specific implementation, at least one fixed contact piece 711 may be further arranged on the card blocking portion 71. When an end of the card gets in touch with the card blocking portion 71, the card may be fixed to the card bracket 70 by the fixed contact piece 711.

In the embodiment of the present application, the card bracket 70 may further include a locking portion 72, which may be symmetrically arranged at two sides of the card bracket 70. When the card is stored and when the locking portion 72 is locked with a card support clip (not shown in the figure) of a pulley, driven by the card support clip, the card bracket 70 may slide along the guide groove. In this way, the card bracket 70 may be pushed to a specified position, at which the card is moved and stored in the guide groove 60.

In the embodiment of the present application, the card storing case may be connected to a pulley (not shown in the figure). When the card is stored, the card and the card bracket are driven to slide by a pulley combination wheel and the card support clip of the pulley.

Specifically, when the card is stored, the card bracket may be withdrawn, by the card support clip of the pulley, from the guide groove of the card storing case to a specified position. After the card is transferred, by the pulley, into the card bracket, the card support clip of the pulley may push, along the guide groove, the card bracket and the card into the card storing case. In this way, an operation of storing the card is completed.

FIG. 2-FIG. 5 respectively show a front view, a left view, a top view, and a stereoscopic view of a card storing case according to an embodiment of the present application. The views shown in FIG. 2-FIG. 5 exhibit an effect of storing a plurality of cards in the card storing case in this embodiment.

In the embodiment of the present application, a card bracket and a guide groove are arranged in the card storing case, such that a card is moved and stored in the guide groove via the card bracket, which not only shortens a transfer path of the card in a process of storing or withdrawing the card, but also reduces operation time in storing or withdrawing the card. The card storing case of this embodiment is provided with a plurality of guide grooves, which not only increases the number of cards stored in the card storing case, but also enhances the capacity of the card storing case.

Finally it should be explained that a relational term (such as a first or a second . . . . ) is merely intended to separate one entity or operation from another entity or operation instead of requiring or hinting any practical relation or sequence exists among these entities or operations. Furthermore, terms such as "comprise", "include" or other variants thereof are intended to cover a non-exclusive "comprise" so that a process, a method, a merchandise or a terminal device comprising a series of elements not only includes these elements, but also includes other elements not listed explicitly, or also includes inherent elements of the process, the method, the merchandise or the terminal device. In the case of no more restrictions, elements restricted by a sentence "include a . . . " do not exclude the fact that additional identical elements may exist in a process, a method, a merchandise or a terminal device of these elements.

A card storing case provided by the present application is described in detail above. Principles and implementations of the present application are elaborated by using specific examples herein, and the description of the foregoing embodiments is merely intended to assist in understanding the method of the present application and the core concept thereof. Also, those of ordinary skill in the art may change, in according with the concept of the present application, a concrete implementation and a scope of application. In conclusion, contents of the specification shall be not interpreted as limiting the present application.

What is claimed is:

1. A card storing case, comprising:

a left plate of the card storing case and a right plate of the card storing case arranged opposite to one another, wherein an inner side of the left plate of the card storing case and an inner side of the right plate of the card storing case are respectively provided with a plurality of guide grooves; and a card bracket slidably arranged in the guide groove;

wherein when a card is transferred into the card bracket, the card bracket slides along the guide groove, such that the card is moved and stored in the guide groove;

the card storing case further comprises an upper connection plate of the card storing case, a lower connection plate of the card storing case, and a support plate of the card storing case; and wherein the card storing case is enclosed and formed by the left plate of the card storing case, the right plate of the card storing case, the upper connection plate of the card storing case, the lower connection plate of the card storing case, and the support plate of the card storing case.

2. The card storing case according to claim 1, wherein the number of the guide grooves in the inner side of the left plate of the card storing case is equal to that of the guide grooves in the inner side of the right plate of the card storing case.

3. The card storing case according to claim 1, wherein the upper connection plate of the card storing case, the lower connection plate of the card storing case and the support plate of the card storing case together form a frame of the card storing case, and both the left plate of the card storing case and the right plate of the card storing case are fixed to the support plate of the card storing case to form the card storing case.

4. The card storing case according to claim 1, wherein the card bracket comprises a card blocking portion arranged at an end of the card bracket, and the card is transferred into the card bracket and gets in touch with the card blocking portion.

5. The card storing case according to claim 4, wherein the card blocking portion further comprises at least one fixed contact piece, and when an end of the card gets in touch with the card blocking portion, the card is fixed to the card bracket by the fixed contact piece.

6. The card storing case according to claim 4, wherein the card bracket further comprises a locking portion, and when the locking portion is locked with a card support clip of a pulley, driven by the card support clip, the card bracket slides along the guide groove.

7. The card storing case according to claim 1, wherein the card storing case is connected to a pulley, and the card and the card bracket are driven to slide by a pulley combination wheel and a card support clip of the pulley.

8. The card storing case according to claim 7, wherein when the card is stored, the card bracket is withdrawn, by the card support clip of the pulley, from the guide groove of the card storing case to a specified position; and after the card is transferred, by the pulley, into the card bracket, the card support clip of the pulley pushes, along the guide groove, the card bracket and the card into the card storing case.

* * * * *